US006039655A

United States Patent [19]

Todokoro

[11] Patent Number: 6,039,655

[45] Date of Patent: Mar. 21, 2000

[54] BOWLING GAME PLATE

[75] Inventor: Masatoshi Todokoro, Matsudo, Japan

[73] Assignee: Staff Co., Ltd., Tokyo, Japan

[21] Appl. No.: 09/198,532

[22] Filed: Nov. 24, 1998

[30] Foreign Application Priority Data

Mar. 24, 1998 [JP] Japan ..... 10-002830 U

[51] Int. Cl.[7] ..... A63D 3/02

[52] U.S. Cl. ..... 473/116; 473/73; 473/83

[58] Field of Search ..... 473/73, 83, 54, 473/87, 102, 103, 104, 105, 110, 113, 116

[56] References Cited

U.S. PATENT DOCUMENTS

| | | | |
|---|---|---|---|
| 759,186 | 5/1904 | McKenzie | 473/103 |
| 1,102,501 | 7/1914 | Hall | 473/104 |
| 2,626,154 | 1/1953 | Lowry | 473/103 |
| 2,946,590 | 7/1960 | Bruner | 473/116 |
| 3,228,685 | 1/1966 | Pullen | 473/83 |
| 3,756,598 | 9/1973 | Maeda | 473/102 |

*Primary Examiner*—William M. Pierce
*Attorney, Agent, or Firm*—Oblon, Spivak, McClelland, Maier & Neustadt, P.C.

[57] ABSTRACT

A bowling game plate having a base plate with a lane and gutter channels on both sides of the lane. A throwing platform is provided on one end of the base plate, the position and the direction of which is variable relative to the lane. The throwing platform has a ballthrowing figure. A portion for standing pins, which is pivotable, is connected to the other end of the base plate and behind it is located a portion for collecting the pins. Poles are provided on both sides of the portion for standing pins. A pin arranging device which can be vertically moved has pin guide holes and is inserted onto the poles. Enlarged portions which have a length larger than the thickness of the pin are formed on both sides of the portion for arranging pins.

2 Claims, 3 Drawing Sheets

BOWLING GAME PLATE

FIELD OF THE INVENTION

This invention relates to a bowling game plate mainly for which children play bowling on a table.

BACKGROUND OF THE INVENTION

Conventionally, such bowling game plates have a construction that a base plate has a lane formed on the top surface thereof, with a ball-throwing figure provided on one end of the base plate, and a portion for standing pins, and have a mechanism that the figure throws a ball to knock down the pins.

In conventional bowling game plates, in the case where one or several pins remain standing after the first throw, when the fallen pins are picked up by fingers to be removed, the remaining pins sometimes slip or are knocked down by being touched with a finger due to the narrow distance between pins. Further, there is a problem that all the pins must be rearranged after the second throwing.

In order to overcome such problems, a bowling game plate has been developed in which the collection of the pin knocked down after the first throw is easy and the rearrangement of the pins after the second throwing is carried out by electric vibration means. However, such a bowling game plate has a complicated structure and is expensive.

The ball thrown by the figure is picked up from the portion for standing the pins or the collection portion, and is returned to the throwing platform.

Furthermore, although the direction and the position of the throwing platform are variable, only a straight ball can be thrown.

Consequently, there is disadvantage in the feeling of being at a live performance of the bowling center where the ball thrown is returned at the original site and a hook ball can be thrown.

SUMMARY OF THE INVENTION

The present invention has been made in light of the above-mentioned situations, and an object of the present invention is to provide a bowling game plate which has a simple structure, which has pins rearranged in a relatively easy manner, and in which there is the feeling of being at a live performance of the bowling center, i.e., the ball can be returned and various kinds of ball can be thrown.

According to the first aspect of the present invention, there is provided a bowling game plate comprising a base plate having a lane and gutter channels provided on both ends of the lane, a throwing platform provided on one end of the base plate, the position and the direction of which throwing platform relative to the said lane is variable, and said throwing platform having a ball-throwing figure, a portion for standing pins, which is rotatable, connected to the other end of the base plate, and a portion for collecting the pins, which is provided on the side opposite to the lane, and also comprising poles provided on both ends of the pin placing face of said portion for standing pins, a pin arranging member which can be vertically moved, having pin guide holes inserted into said poles to be divided into two portions, and enlarged portions, which have a length larger than the thickness of the pin, formed on both side ends of the portion for arranging pins of the poles.

The second aspect of the present invention is the bowling game plate as described in the first aspect of the invention, wherein at least one of said gutter channels is slanted toward the said throwing platform, and a opening is formed on the terminal of the gutter channel, a device for collecting a ball is provided on the base plate at the portion of the opening, and a rotating lever is provided on the base plate, one end of which being in contact with a push button provided on said device for collecting a ball and the other end being face to said opening.

The third aspect of the present invention is the bowling game plate as described in the first aspect or second of the invention, wherein a rotating knob is provided on the outer face of the base plate in adjacent to said portion for standing pins, and a lane slanting device is provided in such a manner that said device is connected to said rotating knob and has a cam projected to the surface of said base plate according to the position of the rotation.

DESCRIPTION OF THE PREFERRED EMBODIMENTS

Figure 1:
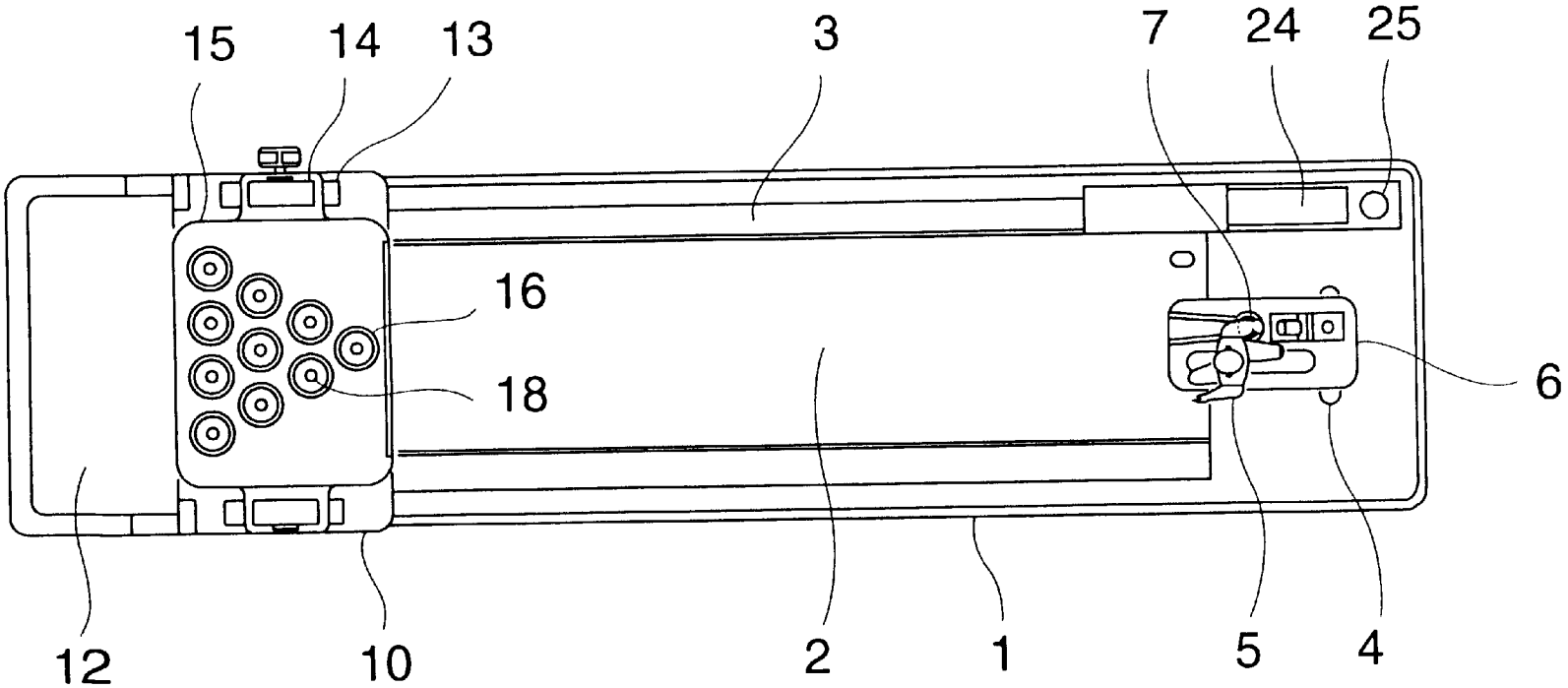
FIG. 1 is a front view of the bowling game plate according to the present invention.

The present invention will now be described by referring to the drawings.

Figure 2:
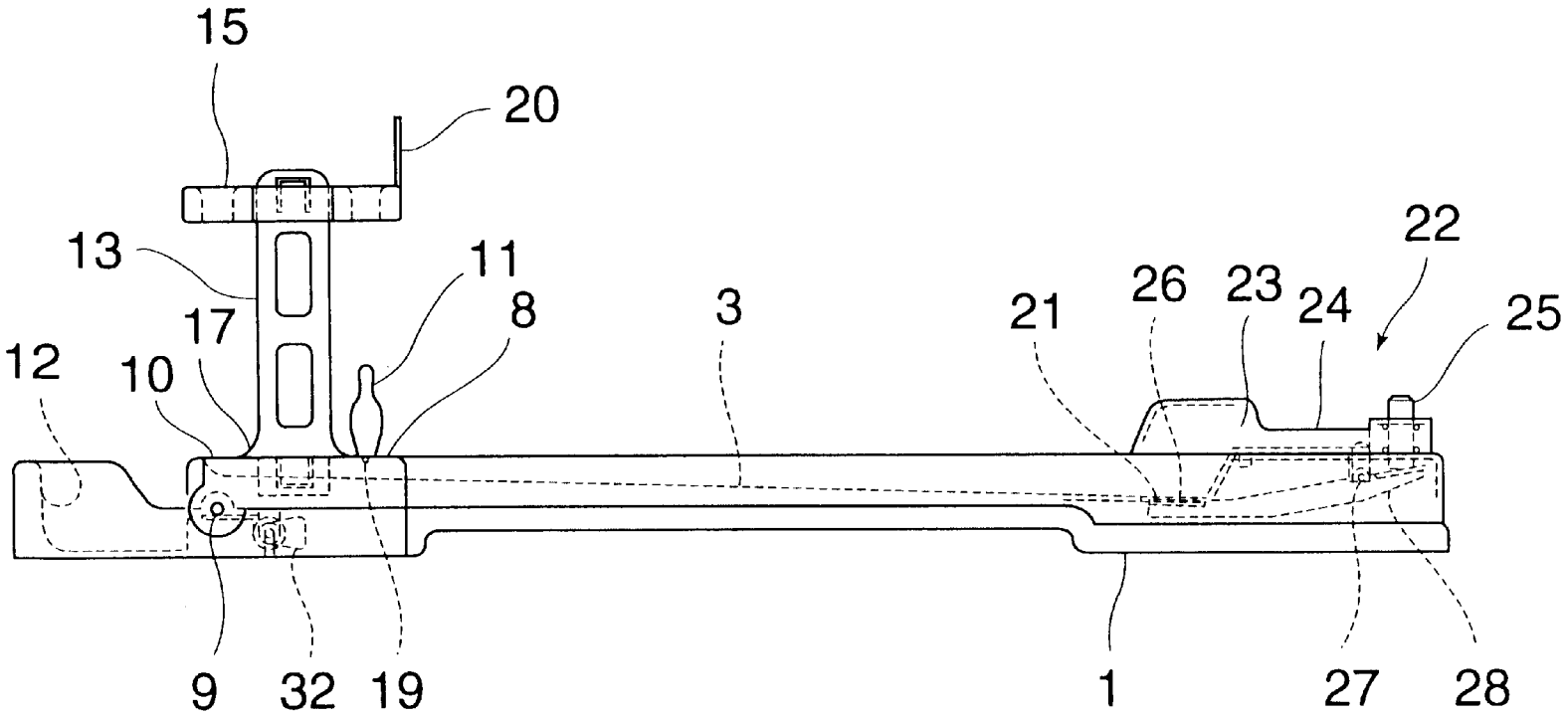
FIG. 2 is a side view of FIG. 1.
Figure 3:
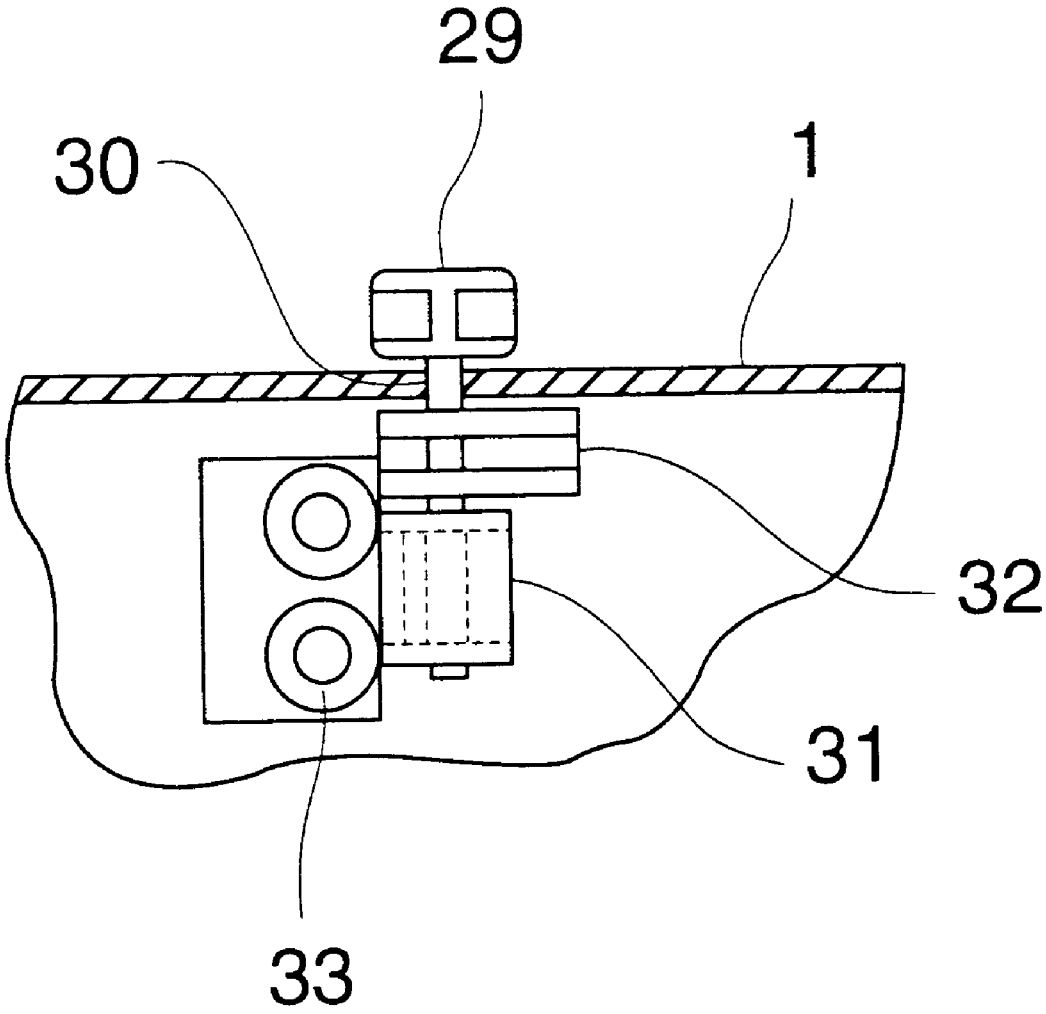
FIG. 3 is a partial front view of the bowling game plate according to the present invention, in which the lane is slanted.

FIG. 1 is a front view of the bowling game plate according to the present invention, FIG. 2 is a side view of FIG. 1, and FIG. 3 is a partial front view of the bowling game plate according to the present invention, in which the lane is slanted.

In FIG. 1, the description of pins are omitted, in FIG. 2, the description of the throwing platform is omitted, and FIG. 3 shows a situation that only one pin remains.

In FIG. 1 and FIG. 2, a base plate 1 has a lane 2, and gutter channels 3 are formed on both sides along the lane 2. On one end of the lane 2 is formed a long rod 4 into which a throwing platform 6, which has a ball-throwing FIG. 5, and which is rotatable and movable, is inserted to set the course of a ball 7 placed on the throwing platform 6.

Moreover, on the other end of the base plate 1, the base plate 1 has a pin arrangement face 8 which is in adjacent to the terminal of the lane 2 and which forms the same face together with the lane 2. On the pin arrangement face 8 is provided pin stands 10, which are connected to the base plate 1 by means of a fulcrum 9. A concave portion 12 for collecting fallen pins 11 is formed on the base plate 1 at the portion of the pin stand 10 at the side other than the lane.

The pin stands 10 have poles 13 which stand on either side of the pin arrangement face 8. The poles 13 have a pin fixing plate 15 having through holes 14 to be inserted into the pole 13 so that the pin fixing plate 15 can be moved vertically.

Through holes 16 which are aligned with the pins 11 are perforated on the pin fixing plate 15 to receive the pins 11 and arrange the pins 11 in a prescribed triangular form. Each of the through holes 16 possesses a slanting face having an enlarged diameter.

An enlarged arch portion 17 is provided on each side of the pin arrangement faces 8 of the poles 13. A communication member (not shown) which temporarily fixes the pin fixing plate 15 is provided at a portion near the top end.

On the pin arrangement face 8, shallow concave portions 18 are placed, and on the bottoms of the pins 11 are provided a convex portion 19 to be inserted into the concave portions 18. These concave and convex portions are placed for the purpose of the stabilization of the pins 11 at the time of arranging the pins 11, and they are formed so as to be easily knocked down by the collision with the ball 7.

According to the construction described above, in the case where all the pins 11 are not knocked down at the first throw, when the communication of the poles 13 with the pin fixing plate 15 is released, the pin fixing plate 15 is slipped down along the poles 13, and then is stopped at the enlarged portion at the lower end of the pole 13. Accordingly, the standing pins can be inserted into and fixed with the though holes 16 without being bought into contact with the standing pins 11 and, thus the bowling game plate can easily be produced in a simple manner that an enlarged portion is provided on the pole.

Thereafter, when a knob 20 of the pin fixing plate 15 is pushed out from the front to pivot the pin platform 10 on the fulcrum, the fallen pins 11 are collected in the concave portion 12. After the pin platform 10 is returned to the original position, one can hold the knob 20 and then pick up the pin fixing plate 15 to the communication portion, whereby the second throw can be made. In this case, after collecting the pins 11 knocked down at the second throw by the similar operation, all of the pins 11, i.e., the pins collected after the first throw and the second throw, are inserted into the through holes 16, and the pin fixing plate 15 is picked up to be communicated. This makes it possible to easily arrange the pins in the prescribed position.

The gutter channels 3 are slightly slanted toward the throwing platform 6, and on the terminal thereof, an opening 21 is formed. The base plate 1 possesses a ball-returning stand 22 on the extension of the gutter channel 3. At an upper portion of the opening 21 of the ball-returning stand 22, a return hole is placed and a push button 25 is provided via ball stopper 24.

In addition, a rotating lever 28 is provided, which possesses a ball receiver 26 on one end facing to the opening 21. At the other end, the rotating lever 28 is in contact with the push button 25 and a fulcrum 27 residing at the middle portion of the rotating lever 28 is communicated to the base plate 1.

Since the slanting of the gutter channel 3 is slight, the ball 7 thrown by the ball-throwing figure 5 does not return along the slanting even if the ball 7 falls within one of the gutter channels 3 in front of the pin arrangement face 8.

According to the construction described above, if the ball 7 is placed in the gutter channel 3 at the side of the ball receiver 22 when the fallen pins 11 are collected or are rearranged after the first throw or the second throw, the ball 7 is rolled back along the slanting of the gutter channel 3 and then mounted on the ball receiver 26 of the rotating lever 28 facing to the opening 21 at the terminal.

At this time, when the push button 25 is pushed up, the rotating lever 28 is rotated clockwise on the fulcrum 27, the ball 7 is returned to the ball stopper 24 via the return hole 23 of the ball-returning stand 22. Consequently, the bowling game plate has the feeling of being at a live performance of the actual bowling center. At the same time, the operation is very easy in that the ball is placed on the gutter channel 3 together with the collection of the pins 11.

In FIG. 3, a knob 29 is provided on the side face of the base plate 1 in which the pin stand 10 is provided. A shaft 30, one end of which passes through the knob 29, extends to the interior of the base plate 1. The other end of the shaft 30 which can be rotatable is inserted in a bearing 31 placed on the base plate 1. A cam 32 is fixed onto the shaft 30, so that the circumference of the cam 32 projects from the bottom of the base plate 1 according to the rotation of the knob 29.

Reference numeral 33 is a screw for fixing the bearing 31 onto the base plate 1. According to the construction described above, since the shaft 30 carrying the cam 32 is connected with the base plate 1 and, at the same time, the circumference of the cam is projected from the bottom surface of the base plate 1 according to the rotation of the knob 29, the lane 2 can be slanted, whereby a wide variety of ball course, such as hook ball, can be realized by the position of rotation of the knob 29 in combination with the direction and the position of the throwing platform 6, making it possible to utilize a complicated technique.

While the invention has been described in detail and with reference to specific embodiments thereof, it will be apparent to one skilled in the art that various changes and modifications can be made therein without departing from the spirit and scope thereof To be specific, the enlarged portion 16 may have several steps instead of the arch shape, the ball-returning stand may not be placed on either side but on both sides of the gutter channel.

As described above, according to the bowling game plate of the present invention, an enlarged portion is placed on a lower end of the pole for vertically moving a pin fixing portion, a slanting portion descending toward the throwing platform is formed and, at the same time, a ball-returning stand and a rotating lever are continuously provided, and a cam which is projected from the bottom surface of the base plate is provided near the pin stand placed on the base plate. Consequently, the remaining pins can be fixed in a simple manner, the ball can be returned only by placing the ball on the gutter channel near the pin arrangement face, and the ball course can be varied due to the slanting of the lane. For these reasons, by the use of complicated technique, bowling game can be played with feeling of being at a live performance of the bowling center.

What is claimed is:

1. A bowling game plate comprising:

a base plate having a lane with two sides and two ends, and gutter channels on either side of said lane;

a throwing platform provided on a first end of said lane;

a portion which receives pins provided on a second end of said lane;

a portion which collects pins, provided on a side of said portion for receiving pins which is opposite to said lane; and a member for arranging pins which is vertically movable;

wherein fallen pins may be collected while retaining standing pins by vertically moving said member for arranging pins, pivoting said portion for receiving pins so that fallen pins are collected in said portion which collects pins while standing pins are held by said member for arranging pins.

2. A bowling game plate comprising:

a base plate having a lane with two sides and two ends, and gutter channels on either side of said lane;

a throwing platform provided on a first end of said lane;

a portion which receives pins provided on a second end of said lane;

a rotating knob mounted on an outer face of said base plate adjacent to said portion which receives pins; and a lane slanting device connected to said rotating knob and having a cam projecting to a surface of said base plate in accordance with the position of said rotating knob for slanting said lane.

* * * * *